United States Patent [19]

Machin

[11] Patent Number: 4,878,330

[45] Date of Patent: Nov. 7, 1989

[54] CONSERVATORY CONSTRUCTION

[76] Inventor: Francis Machin, South Flat, Ransome's Dock, Parkgate Road, London, SW11 4NP, England

[21] Appl. No.: 62,978

[22] Filed: Jun. 17, 1987

[30] Foreign Application Priority Data

Jun. 17, 1986 [GB] United Kingdom ..... 8614723

[51] Int. Cl.[4] ..... E06B 3/54

[52] U.S. Cl. ..... 52/475; 52/90; 52/582

[58] Field of Search ..... 52/80, 82, 86, 90, 92, 52/93, 220, 221, 235, 263, 280, 281, 283, 475, 582, 586, 404; 47/17

[56] References Cited

U.S. PATENT DOCUMENTS

| | | | |
|---|---|---|---|
| 2,808,136 | 10/1957 | Hammitt et al. | 52/220 X |
| 3,698,149 | 10/1972 | Baker et al. | 52/731 |
| 3,738,083 | 6/1973 | Shimano | 52/582 |
| 4,069,627 | 1/1978 | Pegg | 52/92 |
| 4,261,143 | 4/1981 | Rizzo | 52/16 |

FOREIGN PATENT DOCUMENTS

| | | | |
|---|---|---|---|
| 999414 | 11/1976 | Canada | 52/220 |
| 1600709 | 10/1981 | United Kingdom | 52/404 |
| 2081354 | 2/1982 | United Kingdom | 52/404 |
| 2127075 | 4/1984 | United Kingdom | 52/404 |

*Primary Examiner*—David A. Scherbel
*Assistant Examiner*—Michele A. Van Patten
*Attorney, Agent, or Firm*—Banner, Birch, McKie & Beckett

[57] ABSTRACT

A conservatory has a structural frame, the components of which are extruded from aluminum and include a plurality or identical mullions (1) uniformly spaced apart to receive and retain standard panes (8) of glass forming the side and end walls, a sill (2) at the lower end of each wall, a roof section including glazing bars (5) uniformly spaced apart to receive and retain the edges of transparent roof panels, preferably of synthetic plastics material, and a head assembly (3) interposed between the upper ends of the walls and the roof section and consisting of three profiled sections (18, 19, 20) mounted one above the other and comprising a lower head section (18) connected to the upper ends of the mullions (1), a curb section (20) connected to the lower ends of the glazing bars (5) and an upper head section (19) interposed between the sections (18, 20) and secured thereto by means of interfitting grooves (22, 27) and projections (21, 28) which are so arranged as to enable the members to be slid transversely relative to one another into interlocking engagement.

11 Claims, 6 Drawing Sheets

38
42
42
40
41
39
32
32
2
32

CONSERVATORY CONSTRUCTION

This invention relates to conservatories and like buildings which consist predominantly of transparent panels mounted in a frame made up of a plurality of interconnected elements extruded from aluminium or other suitable light-weight metal and its principal object is to provide a modular structure of great strength which is easy to assemble from a minimum number of different frame elements.

To this end, according to a principal feature of the invention, there is provided a structural frame for a conservatory or like glazed building having side and end walls each comprising a plurality of spaced mullions to receive the edges of a plurality of transparent wall panels, horizontal sills joining the lower ends of said mullions, a roof comprising a plurality of spaced glazing bars to receive the edges of a plurality of transparent roof panels and a horizontally extending head structure interposed continuously between the roof and the side and end walls and comprising a lower head member which connects the upper ends of the mullions, an upper head member secured to the upper end of said lower head member and a kerb member which is secured on the one hand to the upper end of said upper head member and on the other hand to the lower end of said roof glazing bars and is provided with a kerb portion which projects beyond the outer faces of said upper and lower head member, all said head members being connected together by means of interfitting grooves and projections which are so arranged as to enable the members to be slid transversely into fixed interlocking engagement with one another whereby all structural loads are transmitted through the interlocking junctions between members and not through separate fixings.

It is another object of the invention to enable electric wiring for lights and for other purposes such as the operation of driving motors for a roof blind assembly, to be hidden within the frame and to this end, according to another aspect of the invention, each mullion is provided with internal and external wiring ducts in the form of channels which open onto the internal and external surfaces of the mullion and can be closed by detachable caps, which ducts communicate at their upper ends, through suitable apertures in the components of the head assembly with a wiring duct formed in a blind track incorporated in one of the roof glazing bars.

The extruded frame elements each consist of inner and outer profiled sections joined by a thermal break in the form of a resin joint in order to isolate internal surfaces and prevent condensation and it is a further object of the invention to ensure the integrity of each member in the event of failure of the resin, by employing a mechanical fixing member, preferably in the form of a bolt which bridges the sections.

Yet another object of the invention is to enable a mullion to be employed as the flange of a structural portal frame, one or more of which may be provided at intervals along the length of the structure to provide lateral restraint in the absence of any other support, and to this end, according to yet another aspect of the invention, the channel forming the internal wiring duct may be left uncapped to receive and secure the outer ends of struts, the inner ends of which are received and secured in an outwardly opening channel of a beam flange for securing a portal frame.

These and other aspects of the invention will be apparent from the following description taken in combination with the accompanying drawings in which.

Figure 1:
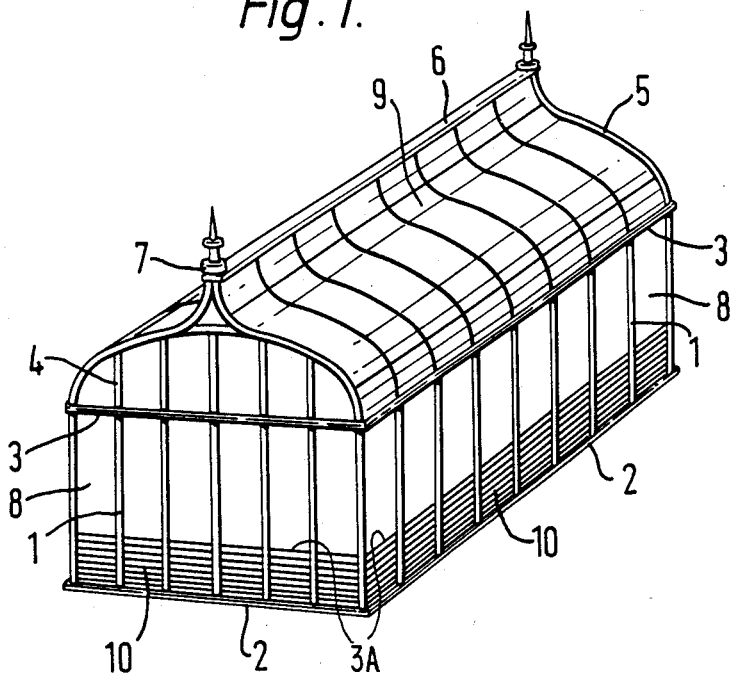
FIG. 1 illustrates one example of a conservatory constructed in accordance with the invention.
Figure 2:
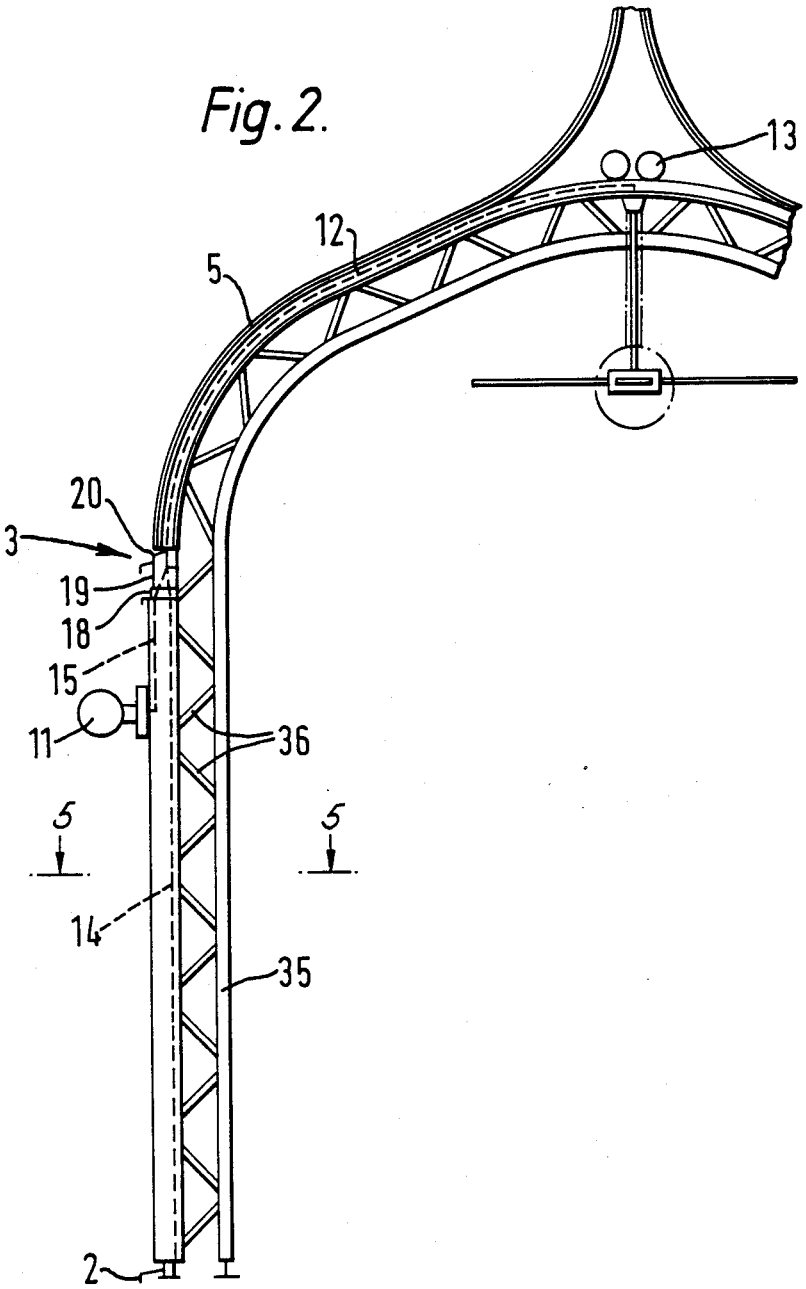
FIG. 2 is a section through one side of the conservatory of FIG. 1 showing the beam flange for a structural portal frame.

The conservatory illustrated in the drawings is of modular construction with uniformly spaced mullions 1 in the form of identical aluminium extrusions extending vertically between horizontal sills 2 at the base of the structure and horizontally extending head assemblies 3 at the junctions between the walls and the roof, and connected together between their ends by transoms 3A. Each end of the conservatory is provided, above its head assembly 3, with further uniformly spaced mullions 4, similar to the mullions 1, but of varying heights depending upon the curve of the roof, the mullions 4 extending vertically between the head assembly 3 and the endmost of a plurality of curved roof glazing bars 5 of aluminium which themselves extend from the head assembly 3 at each side of the structure to a longitudinal ridge 6 which is preferably provided with a ventilator and terminates at each end of the roof in finials 7 made of glass fibre reinforced synthetic plastics material. The mullions 1 and 4 are formed to receive the edges of standardized panes 8 of glass and the roof glazing bars 5 are suitably formed to receive and secure the edges of transparent glazing panels 9 of transparent polyvinyl chloride or other suitable synthetic plastics material. Ventilation is provided at the lower ends of the walls by aluminium louvres 10 extending between adjacent mullions 1. Lights 11, only one of which is shown in FIG. 2, may be mounted on the outside and inside of the mullions 1 and roof glazing bars 5 and the latter may incorporate blind tracks 12 for sunblinds (not shown) which can be extended and retracted by electric motors 13.

To accommodate the electric wiring for the lights 11 and the blind motors 13 each mullion 1 may be provided with an internal wiring duct 14 and an external wiring duct 15 in the form of channels which open onto the internal and external surfaces respectively of the mullion and can be closed by detachable caps 16, 17. The wiring ducts 14, 15 in the mullions 1 communicate with wiring ducts provided in the blind tracks 12 on the roof glazing bars 5 through apertures (not shown) formed in the individual components of each assembly 2, said components being three aluminium extruded sections in the form of a lower head 18, an upper head 19 and a kerb 20 shown in more detail in FIG. 3.

Figure 3:
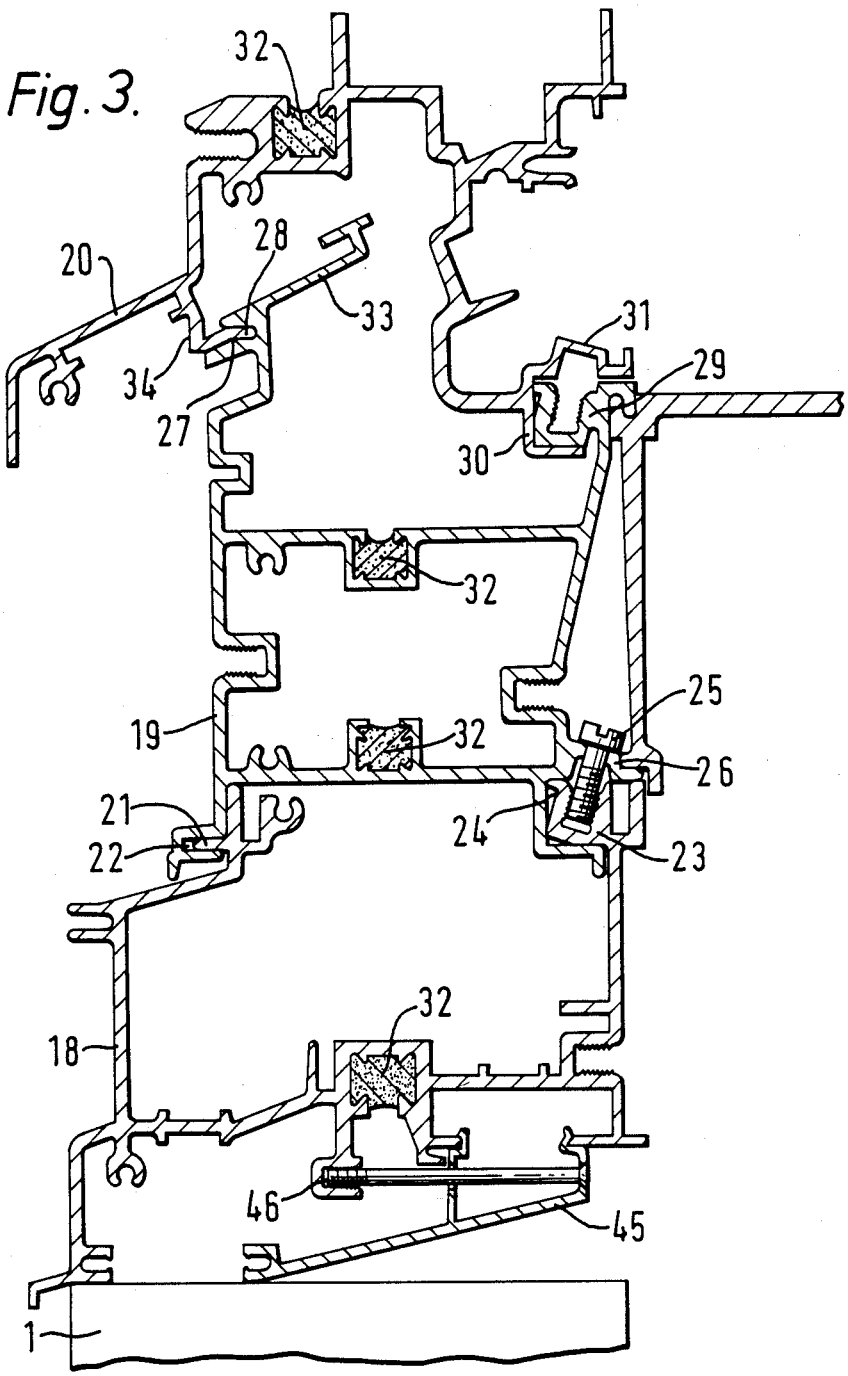
FIG. 3 is a cross section through the head assembly.
Figure 4:
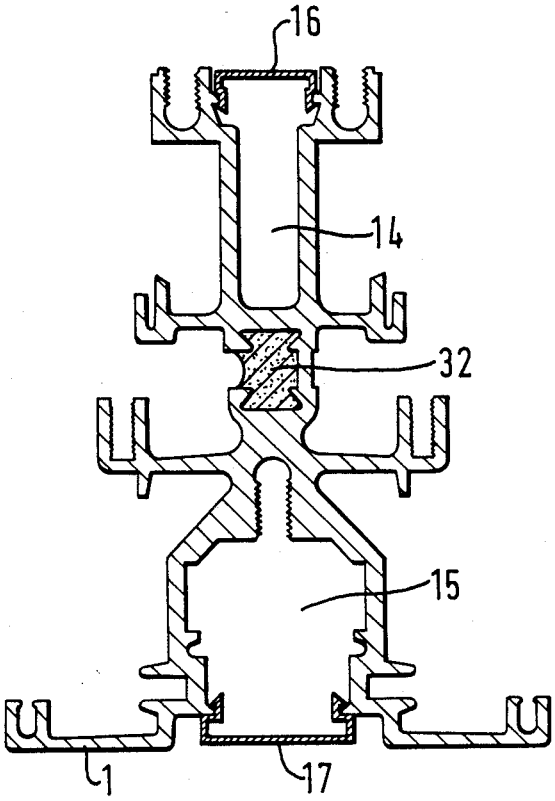
FIG. 4 is a horizontal section through the upper part of a mullion.

It will be seen from FIG. 3 that the lower head 18, which is suitably secured to the upper ends of the mullions 1, is provided with a tongue 21 at its outer end which enters a slot 22 provided adjacent the lower end of the upper head 19 and a socket 23 at its inner end which enters a recess 24 formed in the lower end of the upper head 19 and receives a retaining screw 25 passing through a portion 26 of the upper head which closes the upper end of said recess. The upper head 19 is formed in its outer face with a slot 27 which receives a fixing tongue 28 on the kerb 20 and a socket 29 for engagement in a recess 30, which socket is similarly adapted to receive a retaining screw (not shown) passing through a portion 31 of the kerb.

It will be seen, therefore, that each of the sections 18, 19 and 20 of the head assembly 3 is formed for secure engagement with the section immediately above or below it by lateral movement of one section relative to the other to form a number of lap joints which succeed in holding the component sections firmly in place and through which all structural loads are transmitted, with the minimum assistance from the screws 25 which merely serve to stop the interlocking parts from becoming disconnected.

When secured together the kerb 20 and upper head section 19 are so positioned with respect to one another that any water which may find its way through a thermal break 32 in the kerb section will fall onto an inclined portion 33 of the upper head section 19, from whence it can run downwardly and out of the head assembly through a drain hole (not shown) provided in a depending portion 34 which carries the fixing tongue 28 for the kerb.

Figure 5:
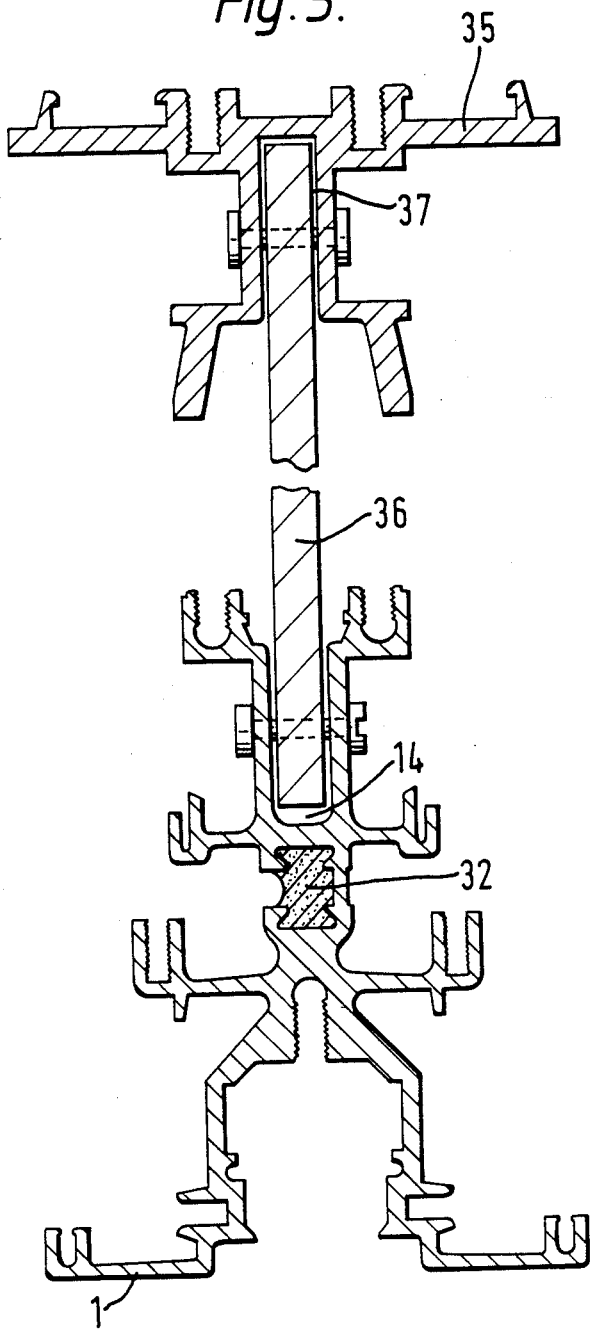
FIG. 5 is a cross-section on the line 5—5 of FIG. 2.

A beam flange 35 (FIG. 2), may be secured to the mullion 1 in the manner shown in FIG. 5 by inclined struts 36 to form a portal frame which provides lateral restraint. The struts 36 are secured at their outer ends in the channel 14 serving as the internal wiring duct of the mullion and, at their inner ends, in an outwardly opening channel 37 in the beam flange.

Figure 6:
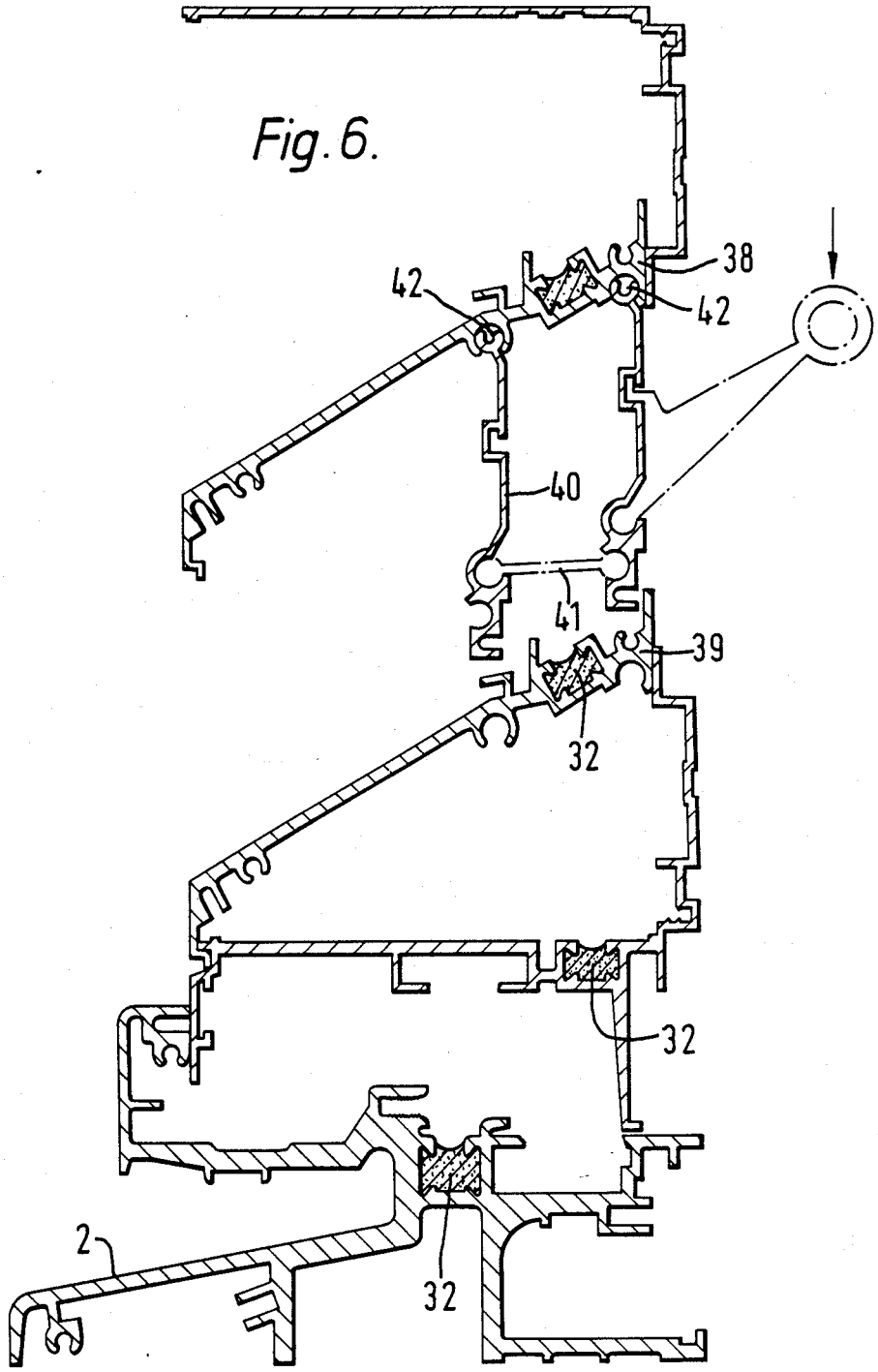
FIG. 6 is a vertical section through a double louvre assembly at the lower end of a wall.

FIG. 6 shows two louvre frames 38, 39 mounted one above the other between the sill 2 and the lower end of the mullions 1. Each of the frames 38, 39 supports a pair of pivotally mounted louvres 40 of which only the louvres mounted in the frame 38 are shown in FIG. 6. Each pair of louvres 40 is connected together by a pivoted link 41 or the like for simultaneous movement about axes 42 between a closed position shown in full lines in FIG. 6 and an open position shown in broken lines.

Thermal breaks 32, in the form of resin joints, are provided between the inner and outer portions of the extruded sections as shown in FIGS. 3 to 6 in order to isolate internal surfaces and prevent condensation and in order to ensure the integrity of each section in the event of failure of the resin, it is preferred to employ mechanical fixing means which bridges the sections joined by the thermal break. Such fixing means, shown, for example, in use on the lower head member 18 in FIG. 3, preferably comprises a bolt 44 which passes through a part 45 detachably secured to the outer section of the head member and is screwed into a threaded socket 46 in the inner section of the member.

I claim:

1. A conservatory or like building comprising a plurality of transparent panels mounted in a lightweight metal frame, which frame comprises side and end wall sections each comprising a plurality of vertically extending mullions uniformly spaced apart in a horizontal direction to receive and retain in weatherproof manner edges of a plurality of standard transparent wall panels, horizontal sills supporting lower ends of said mullions, a roof section having a plurality of glazing bars uniformly spaced to receive and retain, in weatherproof manner, edges of a plurality of transparent roof panels, and a horizontally extending head assembly interposed continuously between the roof section and all the wall sections characterized in that said head assembly comprises a lower head member which connects upper ends of the mullions, an upper head member surmounting and directly secured to the lower head member and a kerb section member which is secured to the top of said upper head section and to lower ends of said roof glazing bars and is provided with a kerb portion which overhangs outer faces of said upper and lower head members, all the members of said head assembly being connected together by means of interfitting grooves and projections provided on said members and so arranged as to enable the members of said head assembly to be slid transversely into fixed interlocking engagement with one another whereby all structural loads are transmitted through interlocking junctions between members of said head assembly and not through separate fixing devices.

2. A conservatory or like building according to claim 1, wherein said mullions are connected together, between their upper and lower ends, by transoms.

3. A conservatory or like building according to claim 1, wherein at least one of said mullions is provided with at least one wiring duct in the form of a longitudinal channel opening along the length of the mullion onto a surface of the mullion and closed by a detachable cover.

4. A conservatory or like building according to claim 3, wherein the channel forming said internal wiring duct also receives the outer end of at least one strut, the inner end of which is received and secured in a longitudinal channel opening outwardly along the length of a beam flange extending parallel with the mullion and cooperating therewith to form a portal frame member.

5. A conservatory or like building according to claim 3 wherein said roof section comprises a plurality of uniformly spaced glazing bars extending transversely between the head assemblies at the upper ends of the side walls and a central ridge.

6. A conservatory or like building according to claim 5, wherein at least one roof glazing bar is provided with a wiring duct which communicates with a wiring duct in the associated mullion through an aperture or apertures in the associated head assembly.

7. A conservatory or like building according to claim 6, wherein said wiring duct forms a part of a blind track provided in said glazing bar.

8. A conservatory or like building according to claim 1, wherein at least one of said frame members comprises inner and outer sections joined by a thermal break in the form of a resin joint.

9. A conservatory or like building according to claim 1, wherein the thermal break is bridged by a mechanical fixing member secured to each of the joined sections.

10. A conservatory or like building according to claim 9, wherein the mechanical fixing member is a bolt.

11. A conservatory or like building according to any preceding claim, wherein said frame members are aluminium extrusions.

* * * * *